US005120918A

United States Patent [19]

Thomas et al.

[11] Patent Number: 5,120,918

[45] Date of Patent: Jun. 9, 1992

[54] VACUUM CIRCUIT INTERRUPTER CONTACTS AND SHIELDS

[75] Inventors: Robert L. Thomas, Horseheads, N.Y.; Natraj C. Iyer, Columbia, S.C.; Allan J. Bamford, deceased, late of Horseheads, N.Y., by Betty C. Bamford, executor

[73] Assignee: Westinghouse Electric Corp., Pittsburgh, Pa.

[21] Appl. No.: 615,109

[22] Filed: Nov. 19, 1990

[51] Int. Cl.[5] ..... H01H 33/66

[52] U.S. Cl. ..... 200/144 B

[58] Field of Search ..... 200/144 B, 262-267; 75/247

[56] References Cited

U.S. PATENT DOCUMENTS

| | | | |
|---|---|---|---|
| 3,818,163 | 6/1974 | Robinson | 200/144 B |
| 3,960,554 | 6/1976 | Gainer, Jr. | 75/200 |
| 4,008,081 | 2/1977 | Hundstad | 75/135 |
| 4,031,301 | 6/1977 | Vinansky, Jr. et al. | 526/328 |
| 4,048,117 | 9/1977 | Emmerich | 252/513 |
| 4,190,753 | 2/1980 | Gainer | 200/144 B |
| 4,302,514 | 11/1981 | Kato et al. | 428/569 |
| 4,323,590 | 4/1982 | Lipperts | 427/38 |
| 4,419,551 | 12/1983 | Kato | 200/144 B |
| 4,430,536 | 2/1984 | Kurosawa et al. | 200/144 B |
| 4,471,184 | 9/1984 | Sano et al. | 200/144 B |
| 4,553,003 | 11/1985 | Cherry | 200/144 B |
| 4,553,007 | 11/1985 | Wayland | 200/144 B |
| 4,766,274 | 8/1988 | Iyer et al. | 200/144 B |
| 4,797,522 | 1/1989 | Voshall | 200/144 B |

*Primary Examiner*—J. R. Scott
*Attorney, Agent, or Firm*—M. J. Moran

[57] ABSTRACT

Copper-chromium contacts and copper-ferrous material shields are used in vacuum circuit interrupters. The copper chromium contacts include a specific copper-iron non-abutting section, and an abutting layer preferably of copper-chromium with a layer thickness that constitutes about 50% of the total thickness of the contact which constitutes the abutting section of the contact structure. The shield for the contacts, are preferably formed of copper-ferrous material and "X" in which 1%-50% is ferrous material, and "X"=chromium 0% to 30% and ferrous material plus "X" is less than 60% of the total shield. The contacts and shields are formed by a powder metallurgical procedure.

15 Claims, 1 Drawing Sheet

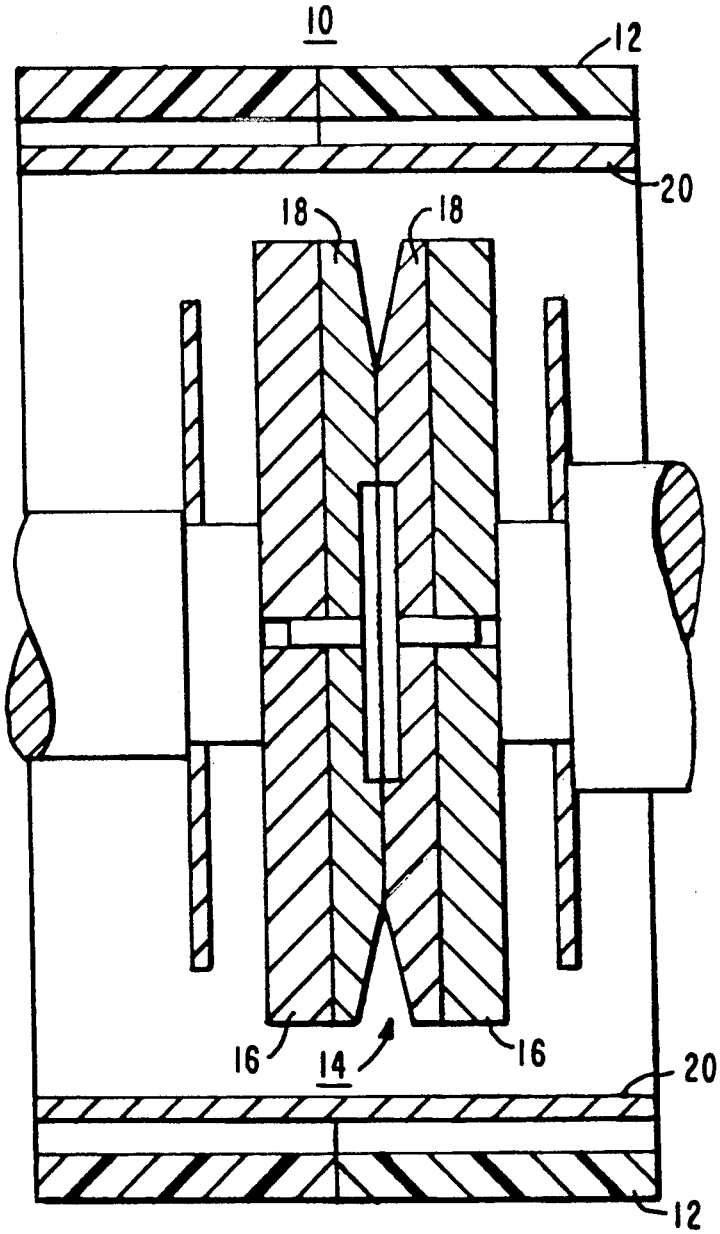
10
12
20
18
18
16
14
16
20
12

VACUUM CIRCUIT INTERRUPTER CONTACTS AND SHIELDS

TECHNICAL FIELD

This invention relates to vacuum-type circuit interrupters and in particular pertains to the structure of contacts and protective shields for the contacts within a vacuum type circuit interrupter.

BACKGROUND OF THE INVENTION

It is known that vacuum-type circuit interrupters generally comprise an evacuated insulated envelope with separable contacts disposed within an insulated envelope. The contacts are movable between a closed position of the circuit-interrupter in which the contacts are firmly engaged and in open position of the circuit interrupter where the contacts are separated to establish an arc gap therebetween. A shield surrounds the contacts. Vacuum-type circuit interrupters are disclosed in U.S. Pat. No. 4,419,551 issued Dec. 6, 1983 in which the contacts are formed from a sintered copper-chromium alloy, with chromium dispersed in a copper matrix. Another vacuum-type circuit interrupter is disclosed in U.S. Pat. No. 4,302,514 issued Nov. 24, 1981 to a contact for a vacuum interrupter which is prepared by uniformly distributing, in a copper matrix, two kinds of high melting point metal powders. Other related U.S. Pat. No. 3,818,163 issued Jun. 18, 1974; U.S. Pat. No. 4,032,301 issued Jun. 28, 1977; U.S. Pat. No. 4,008,081 issued February, 1977; U.S. Pat. No. 4,190,753 issued Feb. 26, 1989; U.S. Pat. No. 4,048,117 issued Sep. 13, 1977; and U.S. Pat. No. 3,960,554 issued Jun. 1, 1976 and U.S. Pat. No. 4,323,590 issued Apr. 6, 1982 all disclose various forms of powdered metallurgical processes for forming vacuum circuit interrupter contacts.

It is also known to manufacture sintered contacts for vacuum circuit interrupters by mixing copper powder and chromium powder in various proportions, pressing them, and then sintering the resulting compacted material at a temperature of about 1050° C. or above 1210° C. which is above the melting point of Copper, as in U.S. Pat. No. 3,960,554 issued Jun. 1, 1976 and assigned to the assignee of the present invention. A powdered metallurgical procedure for manufacturing contacts is disclosed in U.S. Pat. No. 4,766,274 and assigned to the assignee of the present invention.

SUMMARY OF THE INVENTION

The present invention discloses a novel structure and techniques for the formation of copper-chromium contacts along with copper-ferrous material forming nonabutting sections in which the contacts include a specific copper-iron non-abutting section, and an abutting layer preferably of copper-chromium with a layer thickness that would vary between 25% to about 50% of the total contact structure.

With regard to the structure of the protective shield for the contacts, the shield would have a composition of copper-ferrous material along with "X" which would be chromium within a range of 0% to 30% and ferrous material plus "X" being less than 60% of the shield composition.

An object of the invention is to provide a contact structure and a surrounding shield which would retain most of the beneficial characteristics of Cu-Cr material, for example, interruption capability, dielectric strength, and anti-welding characteristics for the contact, and yet offer the potential for lower costs through use of inexpensive ferrous material powder in the non-abutting section of the contact, and for forming a part of the composition of the shield structure.

Further objects would be to exploit the improved electrical characteristics of the differential electrical conductivities of the differential materials used in the contacts and in the shields.

BRIEF DESCRIPTION OF THE DRAWINGS

For a better understanding of the invention, the invention will now be described, by way of example, with reference to the accompanying drawings, which depicts an internal contact structure and shield of a vacuum type circuit interrupter.

In the manufacture of vacuum type circuit interrupters, certain components are of considerable importance, for example, the contact structure and the protective shields.

In accordance with the present invention, as shown in the drawing, this depicts a section of a vacuum type circuit interrupter 10 comprising an insulated casing 12, a contact structure 14 formed with a non-abutting section 16, and an abutting layer 18. The insulating casing has a protective shield 20 to prevent the arcing products of the contact structure 14 damaging the inner surfaces of the casing 12.

Preferably, said vacuum-type circuit interrupter comprises a copper-chromium contact in which said contact includes the copper-iron non-abutting section of the contact 16 formed with copper and iron and an abutting layer 18 formed of copper and chromium, in which said non-abutting section is between 25% to about 50% of the total contact structure, and the abutting layer of copper and chromium forming the rest of the contact, and the protective shield 20, for protecting the inside of the vacuum type circuit interrupting from the erosion products of the contact in which the shield has a composition of copper, ferrous material and "X", with "X" being chromium, within a range from 0% to 30% and Fe+"X" being less than 60% of the shield composition.

Advantageously, in such a vacuum type circuit interrupter the abutting layer of copper-chromium constitutes about 50% of the total thickness of the contact structure.

In a preferred embodiment, said abutting layer includes additions of Bi, Li, and Mg in the range of 1% to 13%.

In another embodiment of said vacuum type circuit interrupter the range in an abutting/non-abutting section would be Cu-25% Cr/Cu-30% Fe contacts to also include Cu-25% Cr-1.5 Bi/Cu-30% Fe.

In another embodiment, the abutting layer 18 may, have a thickness of 25% to about 100% of the total thickness of the contact structure, with a preferred thickness of about 50% of the total thickness of the contact structure.

With regard to the powder composition, the composition of the abutting layer 18 is 12 wt % to 60 wt % Cr in a Cu-Cr-X powder blend, with possible additions of X=Bi, Li, Mg, etc. in the 1-13% range. Composition of the non-abutting layer is 1 wt % to 60 wt % Fe in a Cu-Fe blend, with a preferred embodiment: Cu-25% Cr/Cu-30% Fe contacts; Cu-25% Cr-1.5% Bi/Cu-30% Fe.

In all cases the Cu-Cr-X powder blend can consist of admixed copper and chromium powders or alternatively consist of prealloyed Cu-Cr powder with additional Cr and X powder if necessary as described in U.S. Pat. No. 4,766,274, assigned to the present assignee. In all cases, the Cu and Cr, X powder may be atomized, chemically reduced, electrolytically formed or by any other powder production process. The powder morphology may be spherical, acicular, irregular etc.

Process for fabricating contacts is as follows:

Process #1:

1. Pour Cu-Fe blend into die cavity, tap to level powder; pour Cu-Cr-X blend into die cavity on top of the Cu-Fe.

2. Apply a pressure of 80,000-150,000 psi to fabricate a contact preform.

3. Sinter in a reducing or vacuum furnace in the 950° to 1250° C. range for 0.5 to 10 hours.

4. Machine contact.

Process #2:

1-3: Steps 1 to 3 of Process #1.

4. Isostatically press sintered contact in 50,000 psi to 125,000 psi range.

5. Re-sinter in vacuum or reducing furnace at 950° C. to 1250° C. range for 0.25 to 10 hours.

6. Machine contact.

Process #3:

1. Steps 1 to 3 of Process #1.

2. Hot isostatically press between 700° C. to 1080° C. in 10,000 psi to 30,000 psi for 0.25 hours to 4 hours.

3 Machine contacts.

Process #4:

1. Prefabricate a container (copper, copper alloy, steel etc.).

2. Pour Cu-Fe powder into container. Level by tapping or pressing.

3. Pour Cu-Cr powder on top. Level by tapping or pressing.

4. Outgas the container containing the powder in the 125°-400° C. range.

5. Seal the container by welding the top cover of the container.—Vacuum weld or weld the top; evacuate through an evacuation port and seal the port.

6. Hot extrude the container at 400° C.-900° C. range through an appropriate die.

7. Remove the container and machine the contacts.

Process #5:

1-5. Steps 1 to 5 of Process #4.

6. Hot isostatically press container in the 700° C. to 1080° C. range; between 10,000 psi and 30,000 psi for 0.25 hours to 6 hours.

Process #6:

1. Place a prefabricated piece of cast Cu-Fe alloy in the die.

2. Pour Cu-Cr-X power on into the die.

3. Press the Cu-Cr-X powder at pressures of 50,000 psi to 125,000 psi.

4. Sinter in the 950° C. to 1100° C. range.

5. Machine time contact.

Process #6A:

1-4. Steps 1 to 4 of Process #6.

5. Re-press under the 80,000 psi to 120,000 psi range.

6. Re-sinter.

7. Machine.

In accordance with the invention, the protective shield 20, is arranged to protect the inside of the vacuum type circuit interrupter from the erosion products of contacts during operation, in which the shield has a composition of copper, ferrous material and "X" with "X" being chromium within a range from 0 to 30% and Fe+"X" being less than 60% of the shield composition. Preferably, the shield comprises Cu and 35% Fe.

In a preferred method of fabricating the protective shield 20 for the vacuum type circuit interrupter, the steps of fabricating would include the pouring of Cu-Fe-X blend into a die cavity, tap to level powder, apply a pressure of about 80,000 to about 150,000 psi to form a shield, sinter the shield in a reducing or vacuum furnace at about 950° C. to 1100° C. range for 0.5 to 10 hours, and machine and form a hollow shield.

In a preferred method, conveniently, the steps would be to initially prefabricate a cylindrical shell container or tube container of copper, or copper alloy, pour Cu-Fe-X powder, in which "X" being chromium, within a range of from 1 to 30% and Fe+"X" being less than 60% of the total shield composition, level by tapping or pressing, outgasing the container containing the powder to 125° to 400° C. range, sealing the container by welding a top cover of the container vacuum weld or weld the top; evacuate through a port and seal, the container hot extrude at 400° to 900° C. range, remove the container and machining the shields. In another form of the method the container is hot isostatically pressed in the range of 700° C. to 1080° C., between 10,000 psi to 30,000 psi for 0.25 hours to 6 hours.

With regard to the powder composition for fabrication of the protective shield 20 in all powder metal processing approaches, the Cu-Fe-Cr powder blend can consist of admixed copper and chromium powders, Fe powder and Cu powder or alternatively consist of prealloyed Cu-Cr powder and Cu-Fe powder with additional Fe, Cr, Cu powder as necessary to make up the final composition. The Cu, Fe and Cr powder may be atomized, chemically reduced, electrolytically formed or by any other powder production process. The powder morphology may be spherical, acicular, irregular. For cast shields, typical casting stock may be used.

Various processes for the fabrication of the shield are possible as follows:

Process #1

1. Pour Cu-Fe-X blend into die cavity, tap to level powder.

2. Apply a pressure of 80,000-150,000 psi to fabricate a shield preform.

3. Sinter in a reducing or vacuum furnace in the 950° to 1100° C. range for 0.5 to 10 hours.

4. Machine shield by boring out the center.

Process #2

1. Same as Process #1 except that use a core in the die during pressing to form a hollow tube preform.

2. Sinter in a reducing or vacuum furnace in the 950° to 1100 C. range for 0.5 to 10 hours.

3. Machine shield.

Process #3

Same as process 1 and 2 except use a rubber bag as the die and use a cold isostatic press to apply isostatic pressure in the 60,000-120,000 psi range.

2. Sinter in a reducing or vacuum furnace in the 950° to 1100° C. range for 0.5 to 10 hours.

3. Machine shield.

Process #4

1. Steps 1 to 3 of Process #1, 2 or 3.

2. Isostatically press sinter contact in 50,000 psi to 125,000 psi range.

3. Re-sinter in vacuum or reducing furnace at 950° C. to 1100° C. range for 0.25 to 10 hours.

4. Machine contact.

Process #5

1. Steps 1 to 3 of Process #1.

2. Hot isostatically press between 700° C. to 1080° C. in 10,000 psi to 30,000 psi for 0.25 hours to 4 hours.

3. Machine contacts.

Process #6

1. Prefabricate a cylindrical shell container or tube container. (Copper, copper alloy, steel etc.)

2. Pour Cu-Fe-X powder into container. Level by tapping or pressing.

3. Out gas the container containing the powder in the 125°-400° C. range.

4. Seal the container by welding the top cover of the container. Vacuum weld or weld the top; evacuate through an evacuation port and seal the port.

5. Hot extrude the container at 400° C-900° C. range through an appropriate die.

6. Remove the container and machine the contacts.

Process #7

1-5. Steps 1 to 5 of Process #4.

6. Hot isostatically press container in the 700° C. to 1080° C. range; between 10,000 psi and 30,000 psi for 0.25 hours to 6 hours.

7. Machine shield.

Process #8

1. Place a prefabricated Cu or Cu-Fe pipe.

2. Plasma or laser deposit a layer of Cu-Fe-X on the internal diameter of the pipe.

3. Machine the shield.

Process #9

1. Melt an appropriate mixture of high purity Cu and Iron cast stock. Use vacuum induction melt or other technique.

2. Pour the melt into a mold with a central core.

3. Break out the mold to remove the casting.

4. Machine the casting to form a shield.

Process #10

1. Melt an appropriate mixture of high purity Cu and Iron cast stock. Use vacuum induction melt or other technique.

2. Pour the melt into a centrifugal caster and cast the shield.

3. Machine the shield.

The novel contact structure and protective shield for this type of vacuum circuit interrupter would considerably reduce the cost of the contact structure and also improve the performance characteristics of the unit.

What is claimed is:

1. The vacuum type circuit interrupter copper-chromium contact in which said contact includes a copper-iron non-abutting section of the contact formed of copper and iron, and an abutting layer formed of copper and chromium in which said non-abutting section is between 25% to about 50% of the total contact structure, and the abutting layer of copper and chromium forming the rest of the contacts.

2. The contact of claim 1, wherein said abutting layer of copper-chromium constitutes about 50% of the total thickness.

3. The contact of claim 2, wherein said abutting layer includes additions of Bi, Li, Mg, in the range of 1% to 13%.

4. The contact of claim 1, in which in the composition of the abutting layer is formed of chromium constituting 12% wt. to 60% wt. in a Cu-Cr-'X' powder blend, with additions of 'X' in the range of 1 to 13% and 'X' includes Bi, Li, Ma and the composition of the non-abutting section is 1% to 60% wt. of ferrous material, in a Cu-Fe blend.

5. The contact of claim 4, wherein the ranges in an abutting/non-abutting sections would be Cu—25% Cr/Cu—30% Fe, contact to also include Cu—25% Cr—1.5% Bi/Cu—30% Fe.

6. The shield, for protecting the inside of a vacuum type circuit interrupter from the erosion products of contacts, in which the shield has a composition of copper, ferrous material, and 'X' with 'X' being chromium, within a range from 0 to 30% and Fe+'X' being less than 60% of the shield composition.

7. The shield as in claim 6, wherein the shield comprises Cu and 35% Fe.

8. The method of fabricating the shield for the vacuum type circuit interrupter, in which the steps of fabricating include: pouring of Cu-Fe-'X' blend into a die cavity, tapping to level powder, applying a pressure of about 80,000 to about 150,000 psi to form a shield, sintering the shield in a reducing or vacuum furnace at about 950° C. to 1100° C. range for 0.5 to 10 hours, and machining and forming a hollow shield.

9. The method of fabricating the shield for a vacuum type circuit interrupter, in which the steps are prefabricating a cylindrical shell container or tube container, of copper, or copper alloy, pouring Cu-Fe-'X' powder, in which 'X' is chromium, within a range of from 0% to 30% and Fe+'X' being less than 60% of the total shield composition, leveling by tapping or pressing, outgasing the container containing the powder in the 125° to 400° C. range, sealing the container by welding a top cover of the container, welding the top; evacuating through a port, sealing the port, hot extruding at 400° to 900° C. range, removing the container and machining the shields.

10. The method of claim 9, including the step of hot isostatically pressing in the range of 700° C. to 1050° C., between 10,000 psi to 30,000 psi for 0.25 hours to 6 hours.

11. The vacuum type circuit interrupter comprising a copper-chromium contact in which said contact includes a copper-iron non-abutting section of the contact formed of copper and iron and an abutting layer formed of copper and chromium, in which said non-abutting section is between 25% to about 50% of the total contact structure, and the abutting layer of copper and chromium forming the rest of the contact, and a shield, for protecting the inside of the vacuum type circuit interrupter from the erosion products of the contacts, in which the shield has a composition of copper, ferrous material and 'X'0 with 'X' being chromium, within a range from 0% to 30% and Fe plus 'X' being less than 60% of the shield composition.

12. The vacuum type circuit interrupter of claim 11, wherein the abutting layer of copper-chromium constitutes about 50% of the total thickness of the content structure.

13. The vacuum type circuit interrupter of claim 12, wherein said abutting layer includes additions of Bi, Li and Mg in the range of 1% to 13%.

14. The vacuum type circuit interrupter of claim 13, wherein the range in an abutting/non-abutting section would be Cu—25% Cr/Cu—30% Fe, contact to also include Cu—25% Cr—1.5 Bi/Cu—30% Fe.

15. The vacuum type circuit interrupter of claim 11, in which the shield comprises Cu and 35% Fe.

* * * * *